US012000284B1

(12) United States Patent
Sleeth

(10) Patent No.: US 12,000,284 B1
(45) Date of Patent: Jun. 4, 2024

(54) SWING ARM PLOW APPARATUSES AND METHODS

(71) Applicant: Swanson Industries, Inc., Morgantown, WV (US)

(72) Inventor: Jason Sleeth, Hundred, WV (US)

( * ) Notice: Subject to any disclaimer, the term of this patent is extended or adjusted under 35 U.S.C. 154(b) by 0 days.

(21) Appl. No.: 18/095,109

(22) Filed: Jan. 10, 2023

(51) Int. Cl.
*E21D 23/04* (2006.01)
*E21D 19/02* (2006.01)

(52) U.S. Cl.
CPC ..... *E21D 23/04* (2013.01); *E21D 19/02* (2013.01)

(58) Field of Classification Search
CPC ..... E21D 19/02; E21D 23/04; E01H 5/06; E01H 5/061; E01H 5/065; E01H 5/067
See application file for complete search history.

(56) References Cited

U.S. PATENT DOCUMENTS 3,659,363 A * 5/1972 Snyder ..... E01H 5/067 37/231
4,045,892 A * 9/1977 Farrell ..... E01H 5/067 37/236
4,275,514 A * 6/1981 Maura ..... E01H 5/065 37/281
5,031,343 A * 7/1991 Houle ..... E01H 5/067 37/231
6,581,307 B1 * 6/2003 Jones ..... E01H 5/067 37/274
9,388,544 B2 * 7/2016 Reeves ..... E01H 10/007
2003/0226289 A1 * 12/2003 Geerligs ..... E01H 5/06 37/268
2013/0160333 A1 * 6/2013 Becicka ..... E01H 5/062 37/231

FOREIGN PATENT DOCUMENTS

AU 2014231213 A1 * 10/2015 ..... E21C 27/02
CN 101970796 A * 2/2011 ..... E21C 35/14
CN 113738269 A * 12/2021

* cited by examiner

*Primary Examiner* — Frederick L Lagman
(74) *Attorney, Agent, or Firm* — Richard W. James

(57) ABSTRACT

A longwall mining swing arm plow. The swing arm plow includes a plow panel attached to a walker-shield connecting bar by a hinge and a sweeping actuator attached to the walker-shield connecting bar at a first end and the swing-arm plow at a second end to push the swing-arm plow in an arc around the hinge.

19 Claims, 12 Drawing Sheets

SWING ARM PLOW APPARATUSES AND METHODS

FIELD OF THE INVENTION

This invention is related to mining, and more particularly to an apparatus and method for clearing falling debris that accumulates when removing a shield from a shield panel in a longwall mine.

BACKGROUND OF THE INVENTION

During longwall mining, a drum or other shear advances along a wall of coal, shearing off a layer of coal for collection. Mine roof supports, such as a panel of shield canopy mine roof supports, contact or are adjacent to the mine roof during the shearing operation to prevent roof collapse. Shields are typically placed next to each other in a line, sometimes referred to as a shield panel, along the mine face. Once shearing has occurred on a section of the longwall coal face, the shield canopy adjacent to the sheared section of the coal face advances forward toward the coal seam face to position the shield for the next shearing cycle.

When a shield is to be removed from the shield panel line of shields, for maintenance or replacement, for example, the shield to be removed is typically pulled perpendicular to the face of the mine, away from its neighboring shield. When the shield is being removed, walker-shields are sometimes used to protect the area near the shield being removed from falling debris. Walker-shields may be used in tandem and may be interconnected by a connecting apparatus, such as an E-shaped bar. As the shield to be removed is pulled away from the shield panel, there is typically some debris that falls from the roof of the mine or from the gob pile behind the line of shields. Such debris must typically be removed to clear the space for a replacement shield or other equipment or personnel. Removing that debris has required a labor and time intensive effort of shoveling and hauling away the debris.

Accordingly, there is a need for a mechanism to automatically remove debris falling near a shield being removed.

There is also a need for a sweeping swing-arm plow that can be operated to sweep debris away from one or more walker-shields.

In addition, there is a need for the sweeping swing-arm plow to be compact so as to minimally obstruct the space in front of the connecting bar.

There is also a need for the swing-arm plow to operate from a remote position to safeguard the operator of the swing-arm plow.

BRIEF DESCRIPTION OF THE DRAWINGS

The accompanying drawings, wherein like reference numerals are employed to designate like components, are included to provide a further understanding of apparatuses and methods for a swing-arm plow, are incorporated in and constitute a part of this specification, and show embodiments of those apparatuses and methods that together with the description serve to explain those apparatuses and methods.

Various other objects, features and advantages of the invention will be readily apparent according to the following description exemplified by the drawings, which are shown by way of example only, wherein.

SUMMARY OF THE INVENTION

In an embodiment, a longwall mining swing arm plow includes a longwall mining walker-shield connecting bar for attachment to one or more walker-shields and a swing-arm plow. The swing-arm plow furthermore includes a plow panel attached to the walker-shield connecting bar by a hinge and a sweeping actuator attached to the walker-shield connecting bar at a first end and the swing-arm plow at a second end to push the swing-arm plow in an arc around the hinge.

In another embodiment, a method of clearing debris around a shield removed from a shield panel in a longwall mining operation includes arranging at least one walker-shield perpendicular to the shield to be removed, attaching the walker-shield to a swing-arm plow with a walker-shield connecting bar, and operating the swing-arm plow to push debris from the vicinity of the shield being removed. That method may furthermore include, returning the swing-arm plow to its original position, moving the walker-shield toward a space previously occupied by the removed shield, and repeating operation of the swing-arm plow.

In yet another embodiment, a method of operating a swing-arm plow includes actuating an extending actuator to extend a sliding plow in alignment with a fixed plow, actuating a sweeping actuator to sweep debris with the fixed and sliding plows, retracting the sweeping actuator, and retracting the extending actuator. That method may also include moving the swing-arm plow using a walker-shield and repeating actuation of the swing-arm plow Other embodiments, which may include one or more parts of the aforementioned apparatus and method or other parts, are also contemplated, and may thus have a broader or different scope than the aforementioned apparatus and method. Thus, the embodiments in this Summary of the Invention are mere examples, and are not intended to limit or define the scope of the invention or claims.

DETAILED DESCRIPTION

Reference will now be made to embodiments of longwall mining swing-arm plow apparatuses and methods, examples of which are shown in the accompanying drawings. Details, features, and advantages of swing-arm plow apparatuses and methods will become further apparent in the following detailed description of embodiments thereof.

Any reference in the specification to "one embodiment," "a certain embodiment," or a similar reference to an embodiment is intended to indicate that a particular feature, structure or characteristic described in connection with the embodiment is included in at least one embodiment of the invention. The appearances of such terms in various places in the specification do not necessarily all refer to the same embodiment. References to "or" are furthermore intended as inclusive, so "or" may indicate one or another of the ored terms or more than one ored term.

Figure 1:
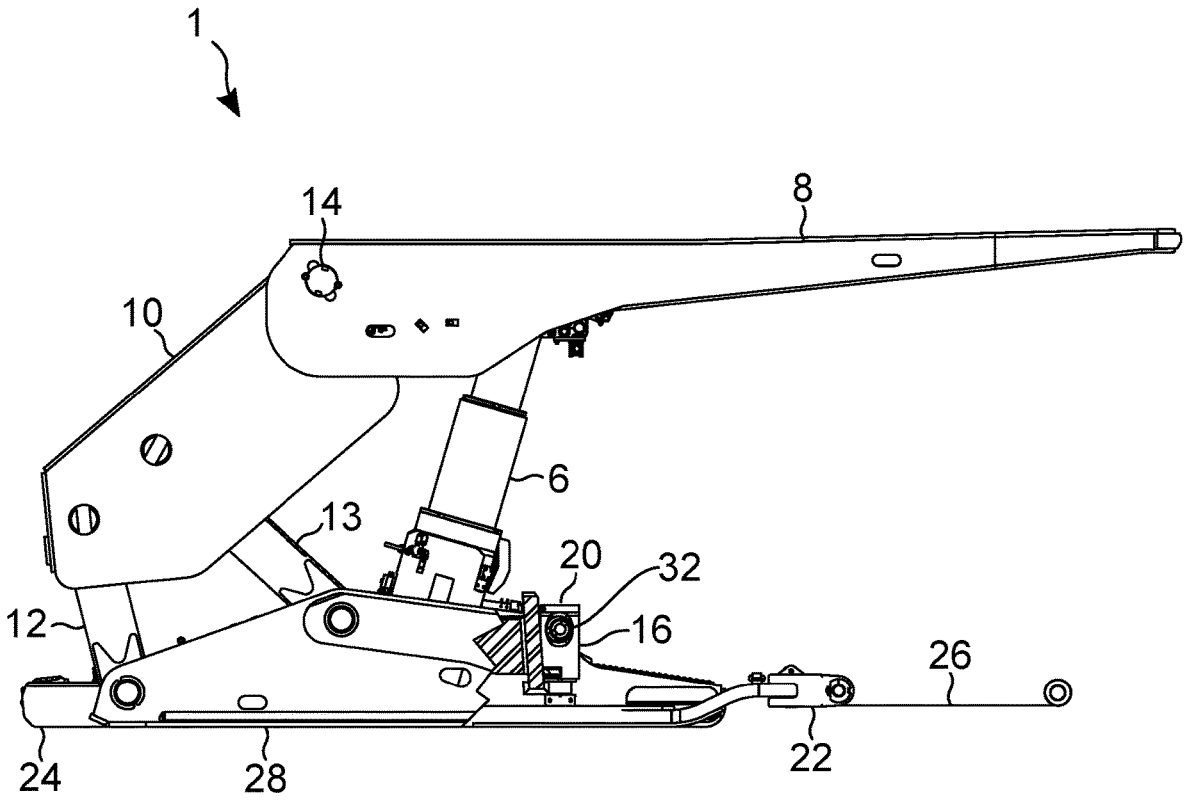
FIG. 1 illustrates a perspective view of a longwall mining shield in accordance with certain mining shield embodiments.
Figure 2:
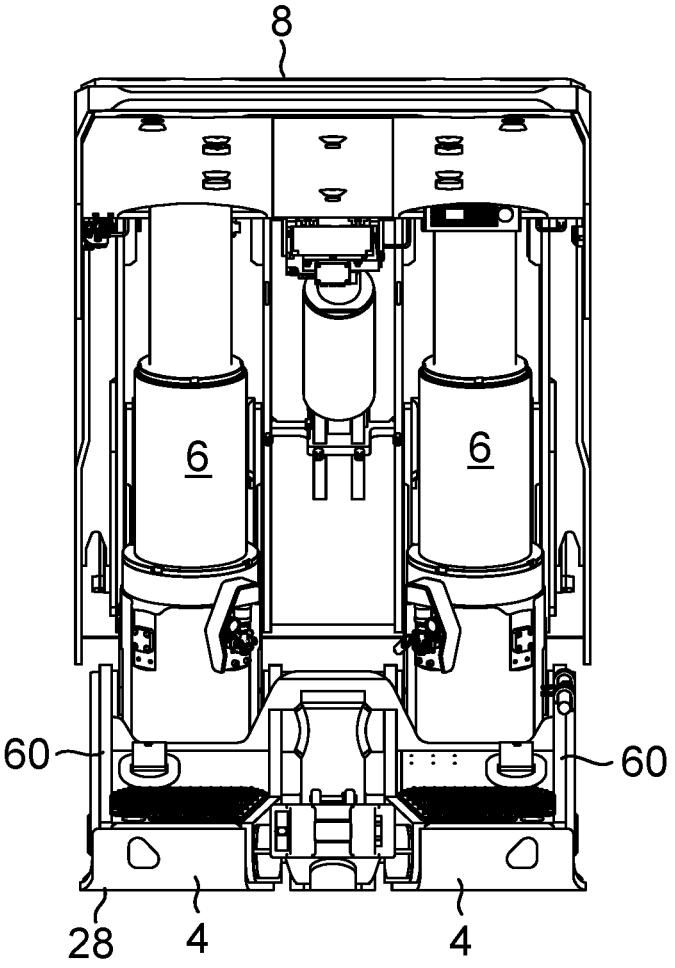
FIG. 2 illustrates a front view of the longwall mining shield embodiment illustrated in FIG. 1.

FIG. 1 is a side view of an embodiment of a longwall mining shield 1 and FIG. 2 is a front view of the longwall mining shield 1 embodiment illustrated in FIG. 1. That embodiment of the longwall mining shield 1 includes two parallel pontoons 4 that support a pair of leg cylinders 6 that, in turn, support the canopy 8. A caving back 10 is connected to the two pontoons 4 by way of front and rear links 12 and 13 and is connected to the canopy 8 by a pin 14. The height of the canopy may be adjusted by hydraulically operating the leg cylinders 6.

An advancing mechanism 16, which includes at least one base lift 20, a relay bar 22 and at least one ram cylinder 24 is also attached to the pontoons 4 to move the shield 1. In normal operation, the shield 1 is attached to a panline 26 through the relay bar 22 and the panline 26 includes a conveyor and a chain that move the sheared coal away from the longwall face 1120. After a depth of coal has been harvested from the longwall, the ram cylinder 24 extends the relay bar 22 out, pushing the panline 26 toward the new longwall face 1120 while the shield 1 is set against the mine roof. To advance the shield 1, the shield 1 canopy 8 is lowered and at least one base lift 20 is hydraulically activated, extending the base lift 20 to press against the relay bar 22 between the pontoons 4, thereby lifting the front of a shield 1 base 28. Once the front of the shield 1 base 28 is lifted, the at least one ram cylinder 24 is retracted pulling the shield 1 toward the longwall face 1120. Once the shield 1 has been moved toward the longwall face 1120, the base lift 20 is deactivated, thereby reducing the length of the base lift 20 and allowing the pontoons 4 to rest on the surface below them. The base lift 20 may then gravitationally swing toward a vertical position, rotating on one or more shafts 32 pivotally connecting the base lift 20 to the shield base 28 so the base lift 20 is positioned for activation for the next advance of the shield 1.

When a shield 1 is to be removed from the longwall shield panel 1112, a walker-shield may be positioned away from the longwall and separate from the panline 26 and used to protect an area around a shield to be removed.

Figure 3:
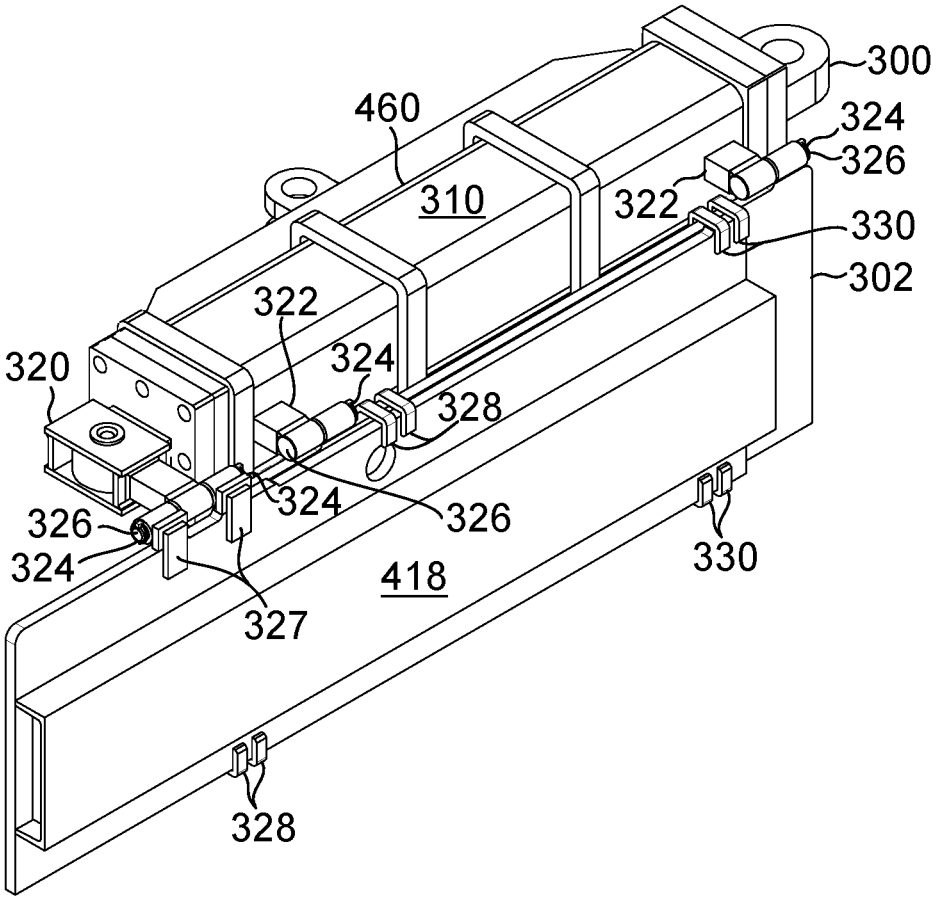
FIG. 3 illustrates a perspective view of an embodiment of a swing-arm plow.
Figure 4:
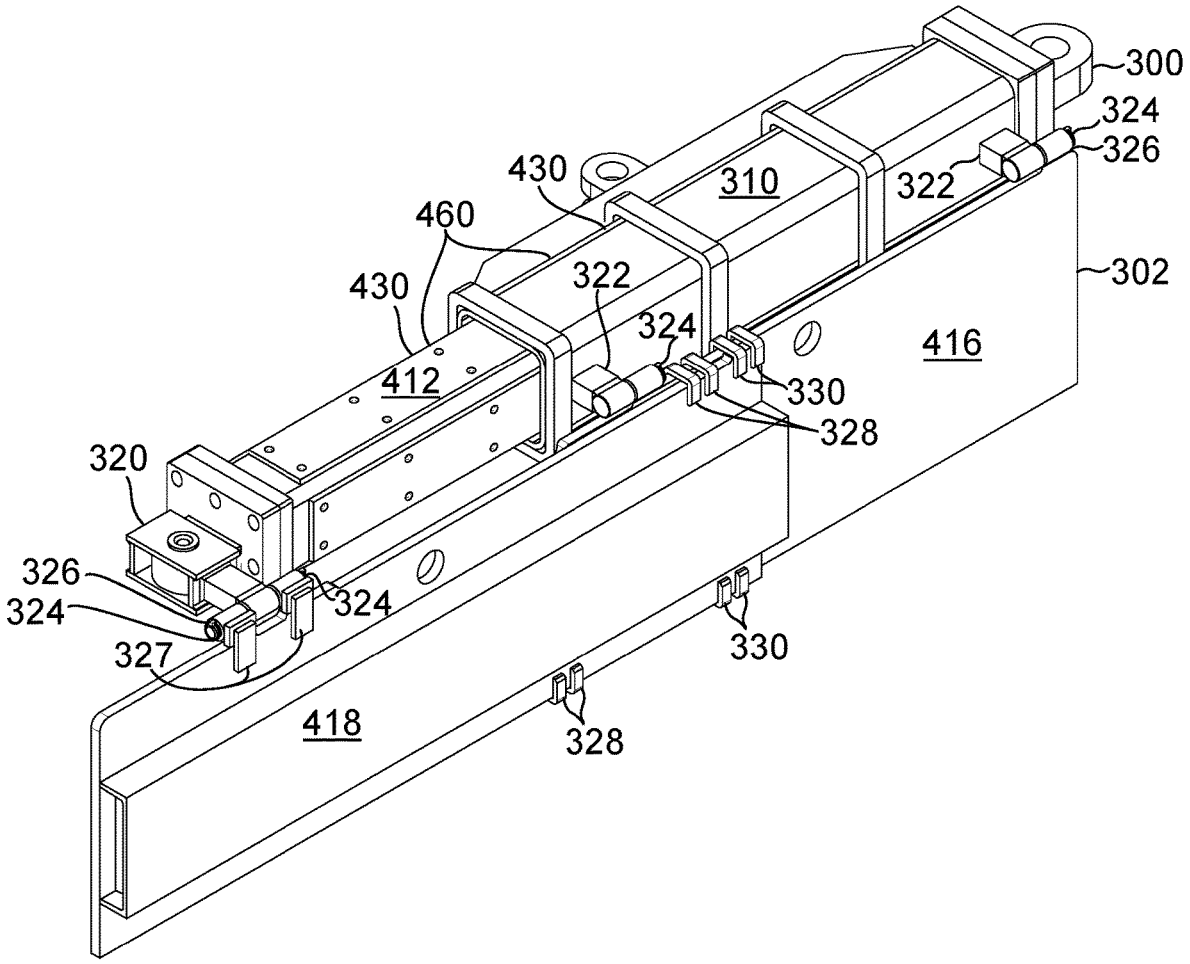
FIG. 4 illustrates the swing-arm plow of FIG. 4 having an extended sliding panel.

FIG. 3 illustrates a perspective view of an embodiment of a swing-arm plow 300. The swing-arm plow 300 includes a first tube 310 attached to a plow panel 302, the plow panel 302 to be positioned adjacent to the ground. A sliding tube 412, illustrated in FIG. 4 as internal to the first tube 310, and a sliding plow panel 418 attached to the sliding tube 412, as illustrated in FIG. 4, may also be attached to the swing-arm plow 300 to extend the length of the plow panel 302 while maintaining a compact plow panel 302 when the plow panel 302 is not in use and the sliding plow panel 418 is retracted.

The relationship between the first tube 310 and the sliding tube 412 may be maintained by, for example, moving the sliding tube 412 in relation to the first tube 310 and keying the first tube 310 and the sliding tube 412 to minimize or prevent rotation of one tube 310, 412 in relation to the other tube 301, 412. For example, as shown in the embodiment illustrated in FIGS. 3 and 4, the sliding tube 412 may slide in relation to the first tube 310. In the embodiment illustrated, the sliding tube 412 slides inside the first tube 310, and the first tube 310 and the sliding tube 412 have cross-sections that are square keyed so that the first tube 310 and sliding tube 412 do not rotate in relation to one another.

A swing-arm bracket 320 may be employed between one of the tubes 310 or 412 and one of the plow panels 302 and 418. In the embodiment illustrated in FIGS. 3 and 4, the swing-arm bracket 320 is attached to the sliding tube 412 and the sliding plow panel 418 to maintain the sliding plow panel 418 in relation to the sliding tube 412.

A plurality of tube-side hinge pin brackets 322 are attached to the first tube 310 or the swing-arm bracket 320 and a plurality of panel-side hinge pin brackets 324 are attached to the plow panel 302 or the sliding plow panel 418. In the embodiment illustrated in FIGS. 3 and 4, one panel-side hinge pin bracket 324 is attached to the swing-arm bracket 320 and two panel-side hinge pin brackets 324 are attached to the plow panel 302, but it should be recognized that other numbers and configurations of panel-side hinge pin brackets 324 could be utilized in the present invention.

A plurality of hinge pins 326 couple the swing-arm bracket 320 and tube-side hinge pin brackets 322 to the plate side hinge pin brackets 324. Accordingly, because of the use of horizontally placed hinge pins 326 to couple the tubes 310, 412 to the panels 302, 418, the panels 302, 418 may move rotationally with respect to the tubes 310, 412. The plow panel 302 may furthermore be arranged so as to strike or contact the first tube 310 or otherwise be prevented from rotating under the tube 310 when the sweeping actuator 520 is extended, and the swing-arm plow panel 415 is moved away from the walker-shield connecting bar 306 so as to push the bottom of the plow panel 302 toward the tubes 310, 412. That causes the plow panel 302 to remain upright when the plow panels 302, 418 are performing their material pushing and debris clearing functions. When the sweeping actuator 520 is retracted, drawing the plow panel toward the walker-shield connecting bar 306, the plow panels 302, 418 may rotate up and away from the tubes 310, 412 on the hinge pins 326.

One or more swing-arm bracket guides 327 may extend from the plate side hinge pin bracket 324 coupled to the swing-arm bracket 320 down along the plow panel 302 or the sliding plow panel 418 to maintain the plow panel 302 or the sliding plow panel 418 in a position relative to the swing-arm bracket 320.

First plate guides 328 may be attached to the plow panel 302 and extend around at least a portion of the sliding plow panel 418 to maintain the sliding plow panel 418 in a position adjacent to the plow panel 302 when the sliding plow panel 418 is moved between and positioned in its retracted position and its extended position. Similarly, second plate guides 330 may be attached to the sliding plow panel 418 and extend around the plow panel 302 to maintain the sliding plow panel 418 in a position adjacent to or in alignment with the plow panel 302 when the sliding plow panel 418 is moved between and positioned in its retracted position and its extended position.

The swing-arm bracket 320, hinge pin brackets 322, 324, hinge pins 326, and guides 327, 328, 330 in that embodiment assist in maintaining the plow panels 310, 418 in relation to the tubes 310, 412 and the plow panels 310, 418, in relation to or in alignment with one another.

FIG. 4 illustrates a perspective view of the swing-arm plow 300 of FIG. 3 with the sliding tube 412 and the sliding plow panel 418 in their extended position. In this embodiment, the first tube 310 and the sliding tube 412 are the outer and inner tubes, respectively, of a hydraulic cylinder 460 in which the sliding tube 412 and the sliding plow panel 418 attached to the sliding tube 412 are extended when the hydraulic cylinder 460 is actuated by the application of pressurized hydraulic fluid thereto and the sliding tube 412. The sliding tube 412 and the sliding plow panel 418 attached to the sliding tube 412 are retracted when the hydraulic fluid is removed from the hydraulic cylinder 460, through the use of a spring or otherwise as is known in the hydraulic industry. In another embodiment, the hydraulic cylinder 460 is double-acting, such that hydraulic fluid is applied both for extension and retraction of the sliding tube 412 and the sliding plow panel 418 attached to the sliding tube 412.

Certain embodiments of the swing-arm plow 300 include a sliding plow panel 418 to extend the length of the swing-arm plow 300 and reduce the length of the slide-arm plow 300. In embodiments, the sliding plow panel 418 may be moveable from a first, retracted position to a second, extended position. In the retracted position, the sliding plow panel 418 may be retracted such that the sliding plow panel 418 is adjacent and substantially in front of or behind the fixed plow panel portion 416. In the extended position, the sliding plow panel 418 may be positioned as an extension beyond the fixed plow panel portion 416 to extend the length of the plow 400 so that it can plow or sweep a larger area than the fixed plow panel portion 416 alone.

In embodiments, an extending actuator 430 is attached to the sliding plow panel 418 at a first end and attached to the fixed plow panel portion 416 or another portion of the swing-arm plow 400 or walker-shield connecting bar 306 at a second end. When actuated, the extending actuator 430 moves the sliding plow panel 418 to a second position as illustrated in FIG. 4 to extend the length of the plow panel 415. The sweeping actuator 520 (illustrated in FIG. 5) may be actuated with the sliding plow panel 418 in its extended position to clear debris from a larger area than would be cleared by the fixed plow panel portion 416 alone and, after the sweeping or plowing operation is completed, the extending actuator 430 may be retracted, thereby minimizing the size of the swing-arm plow 400 when the swing-arm plow 400 is not in operation.

The external tube 310 in the embodiment illustrated in FIG. 4 has a fixed plow panel portion 416 attached thereto and the internal tube 412 has a sliding plow panel 418 attached thereto. The panels 416 and 418 may be formed of steel and affixed to the external tube 310 and the internal tube 412, respectively, by welding or otherwise as desired.

Figure 5:
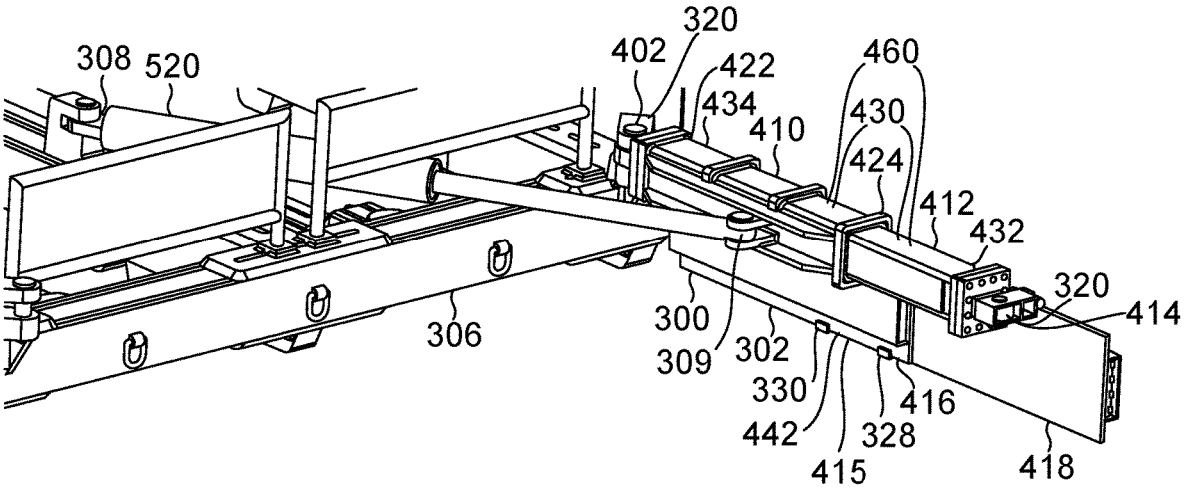
FIG. 5 illustrates a walker-shield connecting bar with a swing-arm plow attached thereto.

FIG. 5 illustrates a walker-shield connecting bar 306 with a swing-arm plow 300 attached thereto by a hinge 402. The swing-arm plow 300 includes a plow panel 302 positioned adjacent to the ground, the swing-arm plow 300 configured to swing away from the walker-shield connecting bar 306 to push debris out of the area under or around the removed shield 1110. A sweeping actuator 520 attached to the walker-shield connecting bar 306 at a first end 308 and the swing-arm plow 300 at a second end 309 pushes the swing-arm plow 300 in an arc around the hinge 402 to push the debris.

The embodiment of the swing-arm plow 300 illustrated in FIG. 5 also includes a sliding plow panel 418 to extend the length of the swing-arm plow 300 and reduce the length of the retracted slide-arm plow 300. The sliding plow panel 418 of this embodiment is retained in relation to the fixed plow panel portion 416 of the plow panel 415 by the swing-arm bracket 320, and guides 328, 330 and the keyed external tube 310 and internal tube 412 of the extending actuator 430. The sliding plow panel 418 in this embodiment is furthermore moveable from a first position wherein the sliding plow panel 418 is adjacent to the fixed plow panel portion 416, to an extended position wherein the sliding plow panel 418 is extended from and aligned with the fixed plow panel portion 416.

The extending actuator 430 is attached to the sliding plow panel 418 at a first end 432 and attached to the fixed plow panel portion 416 of the swing-arm plow 300 at a second end 434 in the embodiment illustrated in FIG. 5. When actuated, the extending actuator 430 moves the sliding plow panel 418 to a second position as illustrated in FIG. 5 to extend the length of the plow panel 415.

The sweeping actuator 520 is attached to the fixed plow panel portion 416 at its first end 522 and attached to the walker-shield connecting bar 306 at its second end 524 in the embodiment illustrated in FIG. 5. The sweeping actuator 520 may be actuated with the sliding plow panel 418 in its extended position to clear debris from a larger area than would be cleared by the fixed plow panel portion 416 alone while minimizing the size of the swing-arm plow 300 when the swing-arm plow 300 is not in operation.

In embodiments of the slide-arm plow 300, the sliding plow panel 418 or the fixed plow panel portion 416 may include a flange 442. That flange 442 may be a continuous bend along the length of the sliding plow panel 418 or fixed plow panel portion 416, a wear-blade attached to the sliding plow panel 418 or fixed plow panel portion 416, or another desired flange 442. One or more first plate guides 328 may be attached to the fixed plow panel portion 416 and extend around the sliding plow panel 418 flange 442 to maintain the sliding plow panel 418 in alignment with the fixed plow panel 416 when the sliding plow panel 418 is extended. One or more second plate guides 330 may be attached to the sliding plow panel 418 and extend around the fixed plow panel portion 416 to additionally or alternatively maintain the sliding plow panel 418 in alignment with the fixed plow panel 416 when the sliding plow panel 418 is extended.

In the embodiment illustrated in FIG. 5, the swing-arm plow 300 includes an external tube 310 fixed to the walker-shield connecting bar 306 by the hinge 402 at a first end 422, and an internal tube 412 that slides at least in part inside the external tube 310 and extends out of a second end 424 of the external tube 310. The extending actuator 430, which may consist of a hydraulic cylinder, electric motor, or other motive force, can be employed to extend the internal tube 412 such that the internal tube 412 extends out from the second end 424 of the external tube 310 to extend the internal tube 412 and the sliding plow panel 418 affixed thereto beyond the second end 424 of the external tube 310, thereby extending the length of the swing-arm plow 300. The embodiment illustrated in FIG. 5 uses a hydraulically operated cylinder 460 to extend the inner tube 412 when the hydraulically operated tube 460 is actuated by injecting pressurized hydraulic fluid into the hydraulically operated cylinder 460. It should be recognized that in alternative embodiments, the sliding tube 412 may be external to the fixed tube 310 and the fixed tube 310 may be internal to the sliding tube 412.

The external tube 310 in the embodiment illustrated in FIG. 5 has a fixed plow panel 416 attached thereto and the internal tube 412 has a sliding plow panel 418 attached thereto. The panels 416 and 418 may be formed of steel and affixed to the external tube 310 and the internal tube 412, respectively, by welding or otherwise as desired.

The hydraulic cylinder sweeping actuator 520 depicted in FIG. 5 has a first end 432 and a second end 434. The first end 432 of the sweeping actuator 520 is attached to walker-shield connecting bar 306 and the second end 434 of the sweeping actuator 520 is attached to the swing-arm plow 300 at, for example, the fixed plow panel 416 or the external tube 310, so that when the sweeping actuator 520 is actuated, the swing-arm plow 300, which includes the plow panel 415 and may include both the fixed plow panel 416 and the sliding plow panel 418 swings in an arc from the hinge 402.

Figure 6:
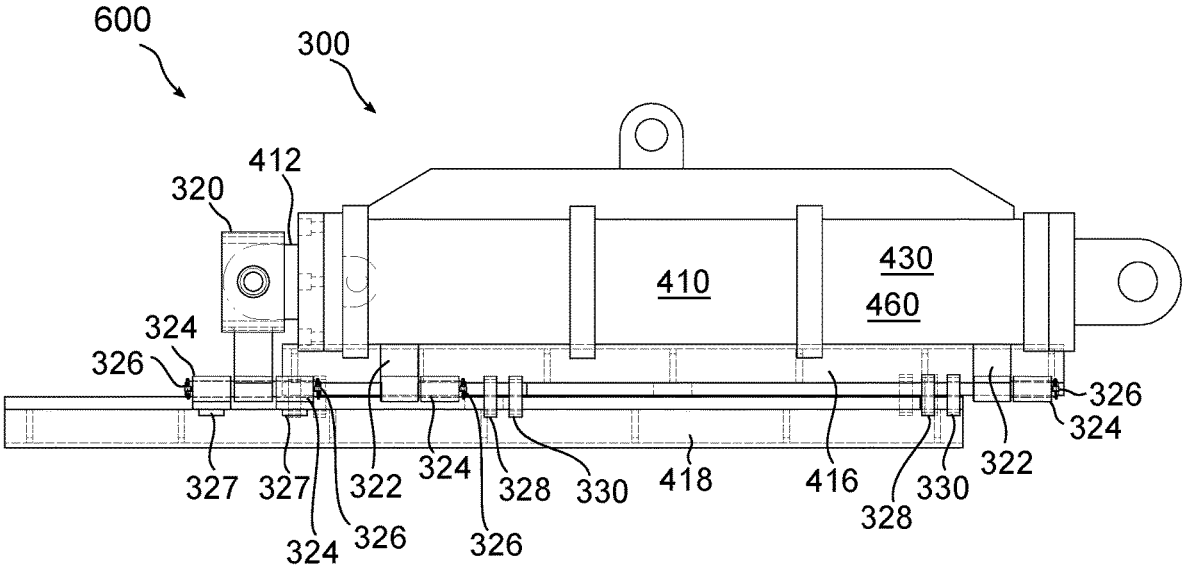
FIG. 6 illustrates a top view of the swing-arm plow of FIGS. 3 and 4.

FIG. 6 illustrates a top view 600 of the swing-arm plow 300 of FIGS. 3 and 4. In that top view 600, the sliding internal tube 412 is retracted such that it is primarily inside the fixed external tube 310. The interconnectivity of the tubes 310, 412 with the fixed plow panel 416 and the sliding plow panel 418 and the interconnectivity between the fixed plow panel and the sliding plow panel may be seen through the use of the swing-arm bracket 320, the tube-side hinge pin brackets 322, the panel-side hinge pin brackets 324, the swing-arm bracket guides 327, the first plate guides 328 and the second plate guides 330.

Figure 7:
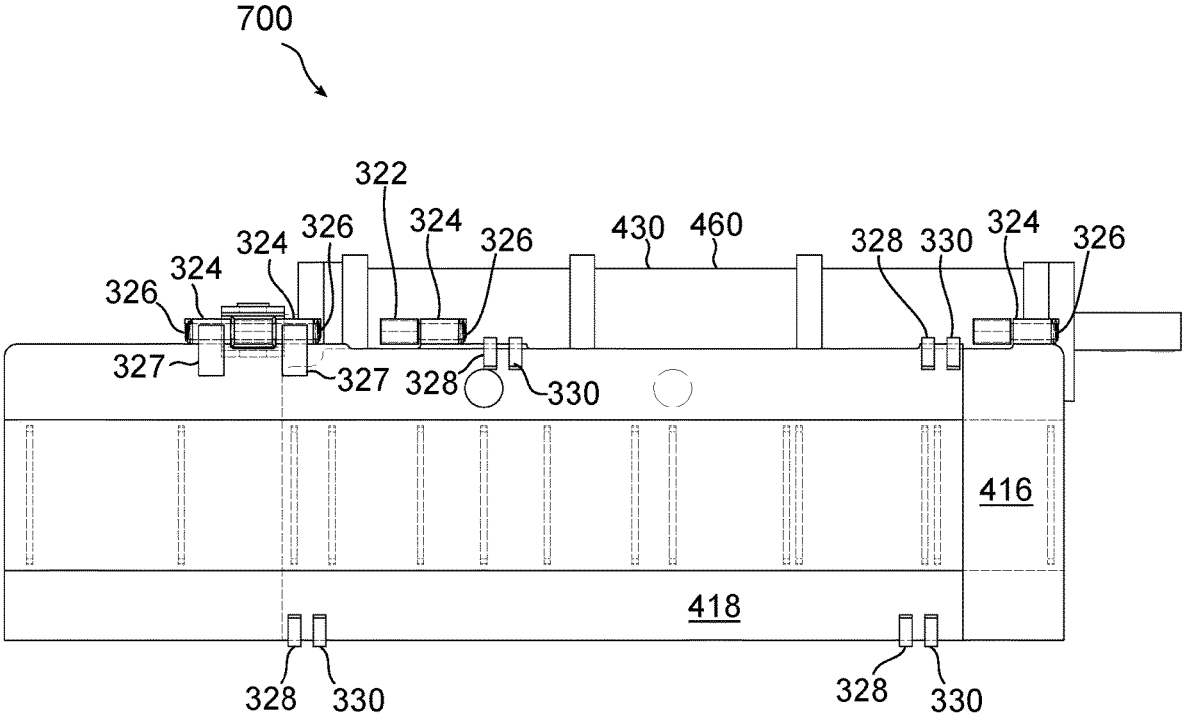
FIG. 7 illustrates a plow plate view of the swing-arm plow of FIGS. 3, 4, and 6.

FIG. 7 illustrates a plow plate view 700 of the swing-arm plow 300 of FIGS. 3, 4, and 6. In that plow plate view 700, the sliding internal tube 412 is retracted such that it is primarily inside the fixed external tube 310, as illustrated in FIG. 6. The interconnectivity of the fixed plow panel 416 and the sliding plow panel 418 may be seen through the use of the swing-arm bracket guides 327, the first plate guides 328 and the second plate guides 330.

Figure 8:
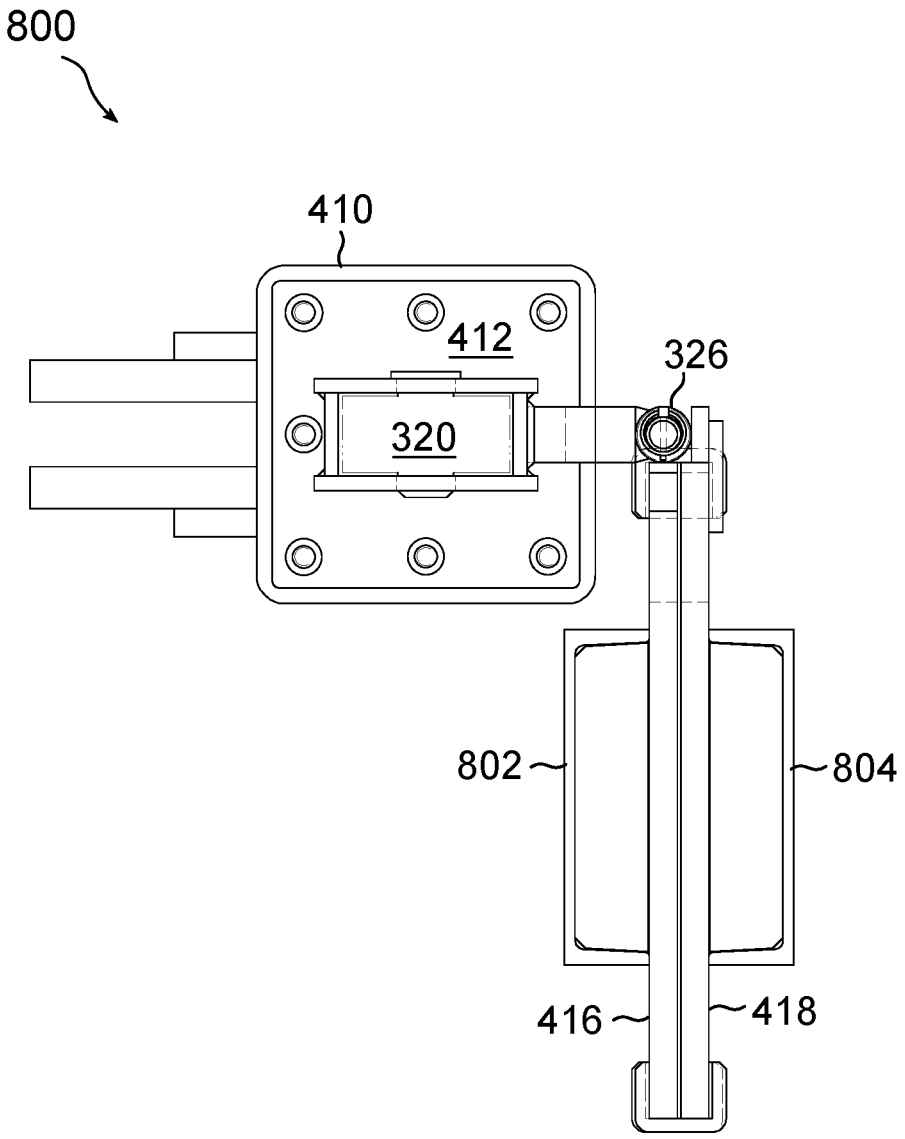
FIG. 8 illustrates and end view of the swing-arm plow of FIGS. 3, 4, 6, and 7.

FIG. 8 illustrates an end view 800 of the swing-arm plow 300 of FIGS. 3, 4, 6 and 7. In that end view 800, the swing-arm bracket 320 may be seen attached to the internal tube 412, which is located inside the external tube 310. A hinge pin 326 is seen attaching the fixed plow panel 416 to the swing-arm bracket 320 and the relation of the fixed plow panel 416 to the sliding plow panel 418 may be readily seen. Reinforcing weldments 802 and 804 may be seen with a fixed plow panel weldment 802 attached by welding or otherwise as desired to the fixed plow panel 416 and a second reinforcing weldment 804 attached to the sliding plow panel 418.

In an embodiment, the swing-arm plow 300 includes an external tube 310 fixed to the walker-shield connecting bar 306 by the hinge 402, and an internal tube 412 that slides at least in part inside the external tube 410. An extending actuator 430, which may consist of a hydraulic cylinder, electric motor, or other motive force, can be employed to extend the internal tube 412 such that the internal tube 412 extends out from a first end 450 of the external tube 310. It should be recognized that in alternative embodiments, the external tube 310 may slide or the internal tube 412 may be fixed. For example, the internal tube 412 may be fixed to the walker-shield connecting bar 306 and the external tube 310 may be extended substantially beyond the internal tube 412.

Figure 9:
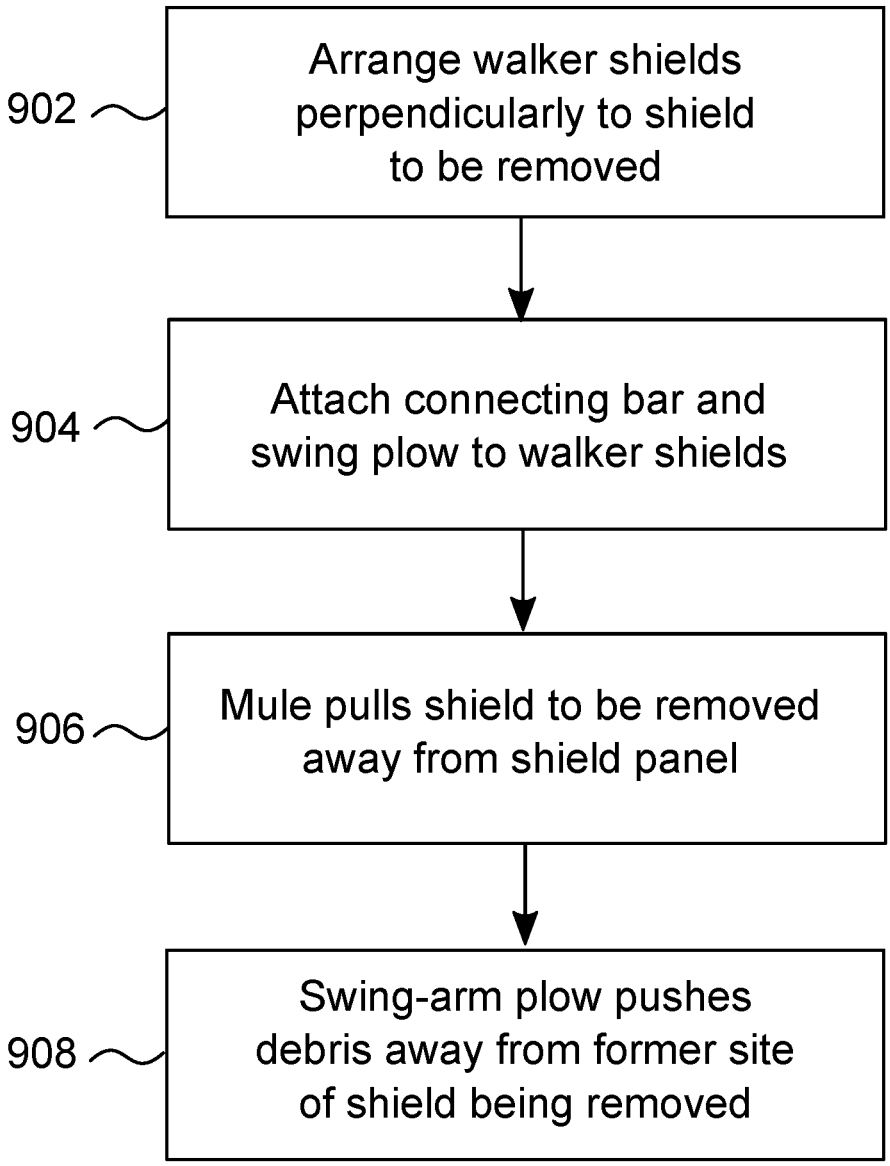
FIG. 9 illustrates a method of removing a shield from a shield panel in a longwall mining operation.

FIG. 9 illustrates a method 900 of removing a shield 1 from a shield panel 1112 in a longwall mining operation. At 902, when a longwall mining shield 1 is to be removed from a shield panel 1112, or line of shields 1 one or more walker-shields 1102 and 1103 (see FIGS. 11 and 12) may be arranged perpendicularly or otherwise as desired to the shield to be removed 1110. The walker-shields 1102 and 1103 may prevent or minimize rock and debris fall in the vicinity of the shield 1110 to be removed when the shield 1110 is moved away from the shield panel 1112. At 904, an "E-shaped" or other shaped walker-shield connecting bar 306, a partial embodiment of which is illustrated in part in FIG. 5 and more fully illustrated embodiments in FIGS. 11 and 12, is attached to the walker-shields 1102 and 1103.

Figure 11:
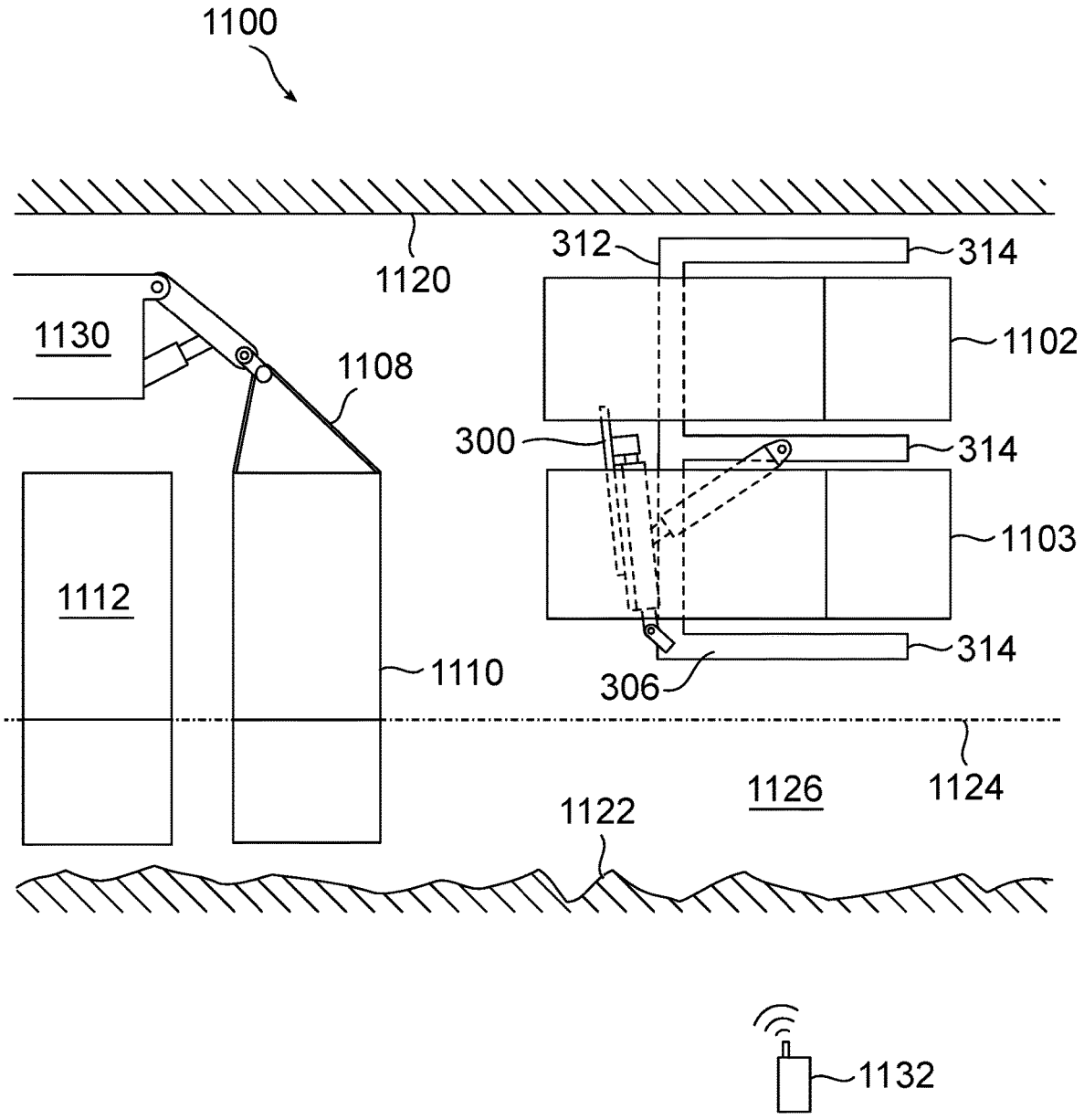
FIG. 11 illustrates a swing-arm plow connected to a pair of walker-shields protecting an area near a shield to be removed.
Figure 12:
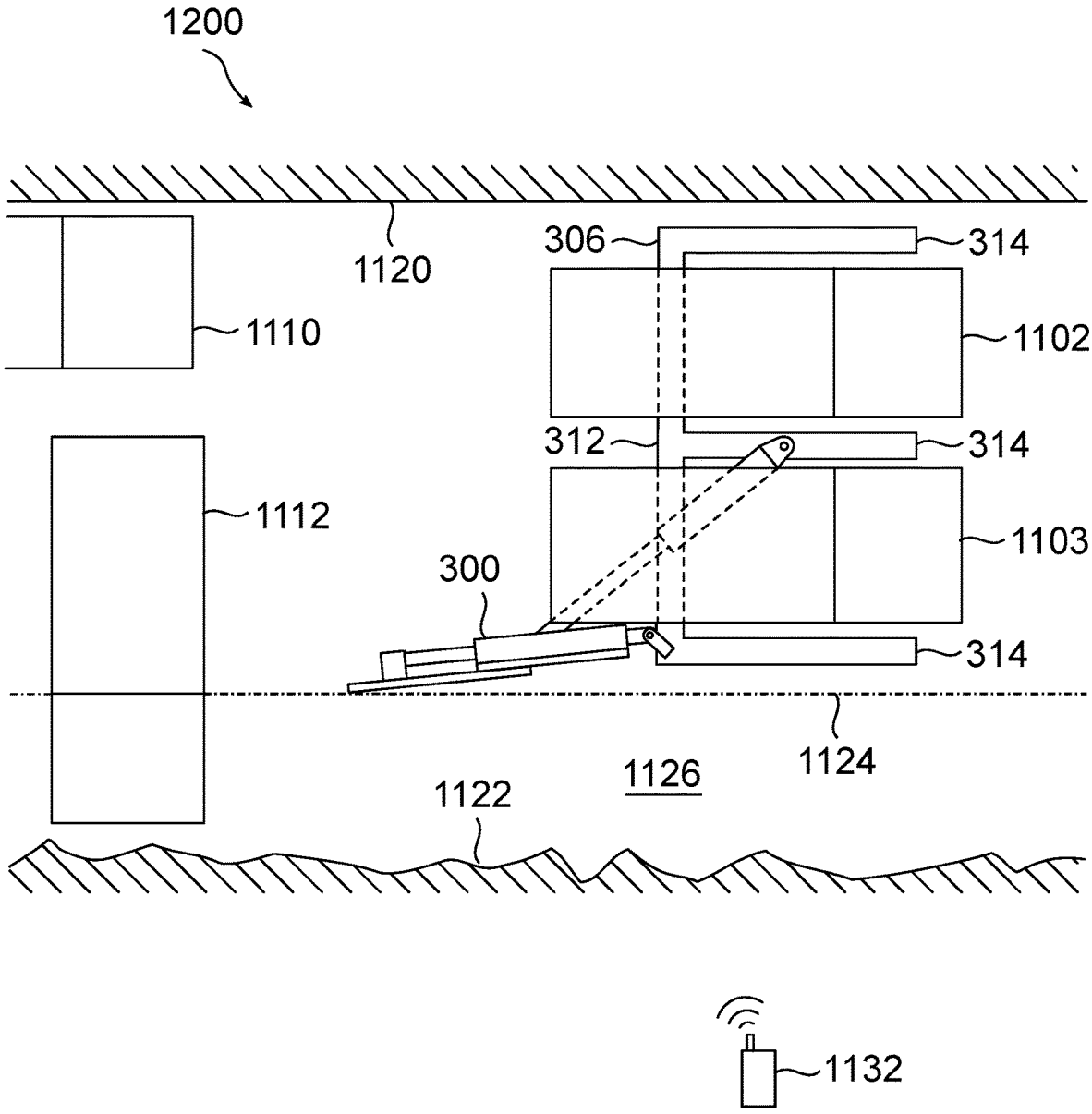
FIG. 12 illustrates the swing-arm plow of FIG. 11 operating to remove debris following the removal of a shield.

The walker-shield connecting bar 306 may include three arms 314, as is shown in FIGS. 11 and 12 that extend from the long side 312 of the walker-shield connecting bar 306 for attachment to the walker-shields 1102 and 1103. Connection of the walker-shield connecting bar 306 to the walker-shields 1102 may be by chains, cables, wire ropes 1108, hooks, or otherwise as desired.

At 906, a mule 1130, which may be an operator-controlled piece of equipment or another desired piece of equipment, removes the shield to be removed 1110 from the shield panel 1112, pulling the shield to be removed 1110 away from the shield panel 1112.

Loose rock debris may accumulate in the vicinity of the shield that is being removed 1110, in front of the walker-shield connecting bar 306 and the walker-shields 1102 and 1103. That accumulating debris must be removed from the area formerly occupied by the shield that was removed 1110. Accordingly, at 908, the swing-arm plow 300, which may be attached to the walker-shield connecting bar 306 and walker-shields 1102 and 1103, is operated to push the accumulating debris away from the site of the shield 1110 that is being removed or was removed. The swing-arm plow 300 may be hinged to the walker-shield connecting bar 306 at a hinge 402 and disposed in a retracted position adjacent the walker-shield connecting bar 306 when not operating. The swing-arm plow 300 may be extended where extension is an option and may pivot on the hinge 402 and swing in a curve from the hinge 402 near the ground in front of the shield removal bar 306 so as to push debris from the vicinity of the walker-shield connecting bar, generally 306 away from the longwall face 1120 and toward the cribbing and netting area 1126 delineated by a line 1124 on FIGS. 11 and 12 and toward the rear of the shield panel 1112 and the gob pile 1122 disposed behind the shield panel 1112. The swing-arm plow 300 may swing in an arc of forty-five degrees or more so as to clean debris lying in the vicinity of the shield removal bar 306 and the location where the removed shield 1110 was formerly situated.

Figure 10:
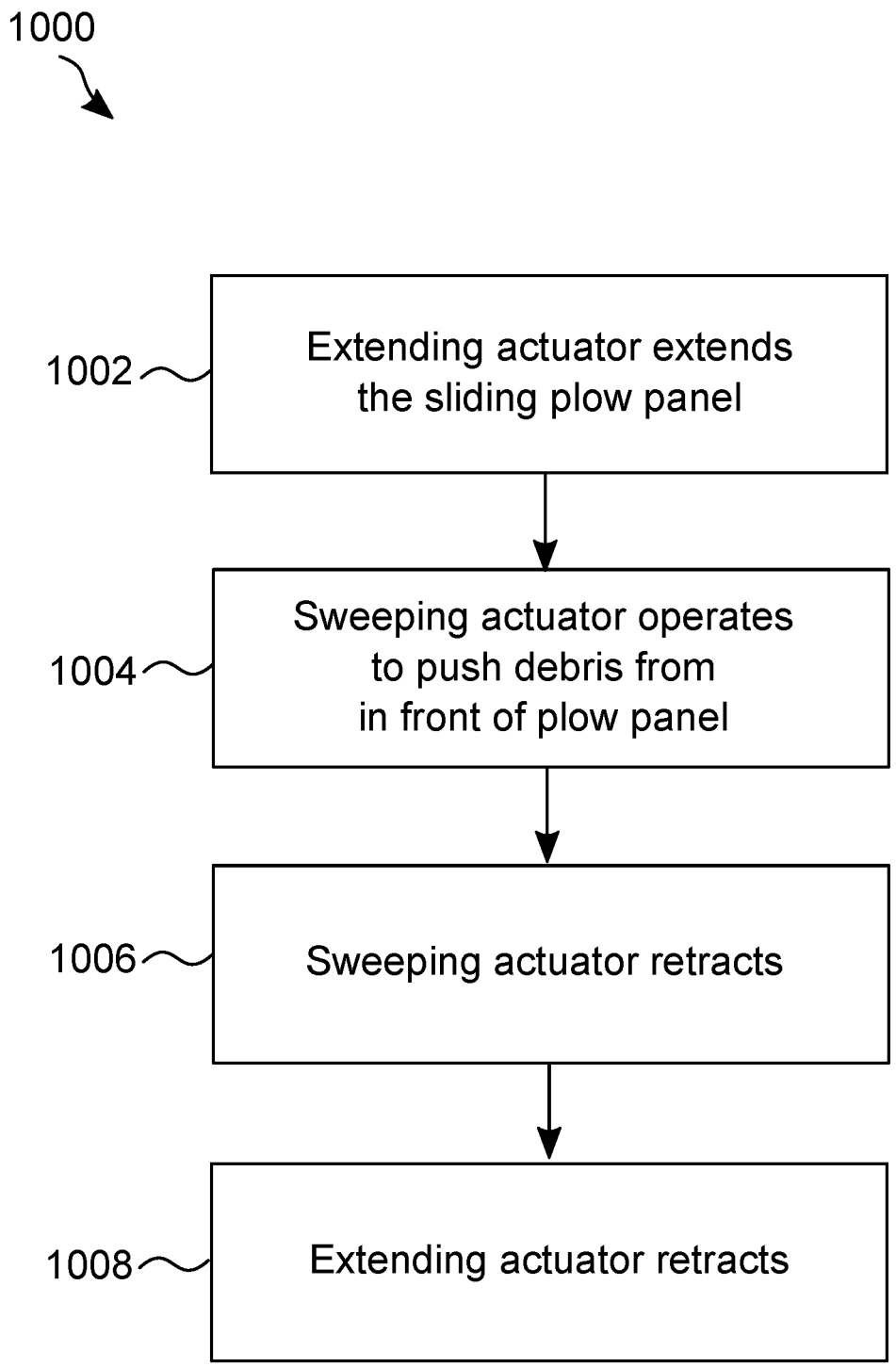
FIG. 10 illustrates a method of operating a swing-arm plow.

FIG. 10 illustrates the operation 1000 of a swing-arm plow 300. At 1002, the extending actuator 430 may extend the sliding plow panel 418 to lengthen the plow panel 415 in embodiments where the swing-arm plow 300 includes a sliding plow panel 418. Once the plow panel 415 is in its operating position, the sweeping actuator 520 is operated at 1004 to push the debris from in front of the plow panel 415, often toward the gob behind the shield panel 1112. At 1006, the sweeping actuator 520 is retracted and at 1008 the extending actuator 430 is retracted, either before or after the sweeping actuator 520 is retracted, to return the swing-arm plow 300 back to its fully retracted position.

In an embodiment, the extending actuator 430 and the sweeping actuator 520 are triggered to actuate by a remote operator using a remote control 1132 (shown in FIGS. 11 and 12). In one embodiment, the remote control is connected to the extending actuator 430 and the sweeping actuator 520 by wires, and in another embodiment, the remote control is connected to the extending actuator 430 and the sweeping actuator 520 wirelessly using Bluetooth, Zigbee, or another wireless technology. The remote control may include binary switches that are pressed or otherwise actuated to separately actuate the extending actuator 430 and the sweeping actuator 520. One switch may be used to move one actuator 430 or 520 from its first position to its second position and another switch may be used to return that actuator 430 or 520 from its second position back to its first position. Alternatively, one switch may be included on the remote control to move an actuator 430 or 520 from its first position to its second position and that same switch may be actuated again to move the actuator 430 or 520 from its second position back to its original, first position. In another embodiment, an analog control may be provided for each device to be actuated on the remote control so that an actuator 430, 520 can be moved through part of its travel range and stopped at a desired place within its range without travelling through its full range.

FIG. 11 illustrates an embodiment of a shield removal arrangement 1100 with a shield 1110 to be removed still in place, while FIG. 12 illustrates that arrangement after the shield 1110 has been removed. The shield removal arrangement 1100 includes at least one walker-shield 1102, and includes two walker-shields 1102 and 1103 in the embodiments illustrated in FIGS. 11 and 12. The walker-shields 1102 and 1103 of those embodiments are coupled to a walker-shield connecting bar 1104 having a swing-arm plow 1106 attached thereto. In those embodiments, the swing-arm plow 300 may be operated prior to, during, or after movement of the shield being removed 1110 to clear debris or other material from around and under the shield 1110 being removed. For example, the swing-arm plow 300 may be operated prior to shield 1110 removal, as illustrated in FIG. 11. The swing-arm plow 300 may be operated again after shield 1110 removal, as is illustrated in FIG. 12. The swing-arm plow 300 may be retracted using the sweeping actuator 520 and the walker-shields 1102 and 1103 may move toward the shield panel 1112 and the swing-arm plow 300 may be operated to sweep one or more times to clear debris from where the shield 1110 that was removed was previously situated.

It should be noted that in embodiments, the walker-shield connecting bar 306 may be directly attached to the one or more walker-shields or the walker-shield connecting bar 306 may be connected by chains, cables, wire ropes 1108, hooks, or the like to the walker-shields 1102 and 1103. It should also be noted that the swing-arm plow 300 may be coupled to the walker-shield connecting bar 306 at various locations and may be actuated to plow either to the rear or the front of the shield panel.

While specific embodiments of the invention have been described in detail, it should be appreciated by those skilled in the art that various modifications and alternations and applications could be developed in light of the overall teachings of the disclosure. Accordingly, the particular arrangements, apparatuses, and methods disclosed are meant to be illustrative only and not limiting as to the scope of the invention.

What is claimed is:

1. A longwall mining swing-arm plow, comprising:

a longwall mining walker-shield having a base and a base lift advancing mechanism to move the longwall mining walker-shield;

a longwall mining walker-shield connecting bar attached to the walker-shield; and a swing-arm plow attached to the walker-shield connecting bar, the swing-arm plow having:

a plow panel attached to the walker-shield connecting bar by a hinge; and a sweeping actuator attached to the walker-shield connecting bar at a first end and the swing-arm plow at a second end to push the swing-arm plow in an arc around the hinge.

2. The apparatus of claim 1, wherein the hinge is a metal rod placed through holes in the walker-shield connecting bar and the swing-arm plow.

3. The apparatus of claim 1, wherein the swing-arm plow is adjacent to the ground.

4. The apparatus of claim 1, further comprising a sliding plow panel, that includes:

a fixed plow panel attached to the walker-shield connecting bar by the hinge;

a sliding plow panel adjacent to the fixed plow panel in a first position and extending lengthwise from the fixed plow panel in a second position; and an extending actuator attached to the fixed plow panel at a first end and the sliding plow panel at a second end, the extending actuator moving the sliding plow panel to the first and second positions.

5. The apparatus of claim 4, further comprising a plurality of guides attached to the fixed plow panel and extending around at least a portion of the sliding plow panel to maintain the sliding plow panel in alignment with the fixed plow panel in both the sliding plow panel retracted position and the sliding plow panel extended position.

6. The apparatus of claim 4, wherein the extending actuator includes a first tube and a second tube, the second tube sliding within the first tube.

7. The apparatus of claim 4, wherein the plurality of hinge pin brackets attach the extending actuator to the fixed plow panel and the sliding plow panel.

8. The apparatus of claim 7, the extending actuator further comprising a first tube and a sliding tube, the sliding tube sliding at least partially within the fixed tube, the fixed plow panel attached to the first tube and the sliding plow panel attached to the sliding tube.

9. The apparatus of claim 8, further comprising a swing-arm bracket attached to the sliding plow panel and attached to the sliding tube by a hinge pin.

10. The apparatus of claim 9, further comprising a plurality of guides attached to the sliding plow panel and extending at least partially around the fixed plow panel to maintain the sliding plow panel in alignment with the fixed plow panel in both the sliding plow panel retracted position and the sliding plow panel extended position.

11. The apparatus of claim 1, wherein the swing-arm plow panel is attached to a tube that is coupled to the sweeping actuator.

12. The apparatus of claim 11, further comprising a plurality of hinge pin brackets attaching the swing-arm plow panel to the tube.

13. The apparatus of claim 12, wherein the swing-arm plow panel contacts the tube, preventing the swing-arm plow panel from rotating toward the tube when the sweeping actuator is extended.

14. A longwall mining swing-arm plow, comprising: a longwall mining walker-shield connecting bar for attachment to at least one walker-shield; and a swing-arm plow attached to the walker-shield connecting bar, the swing-arm plow having:

a fixed plow panel attached to the walker-shield connecting bar by a hinge;

a sliding plow panel adjacent to the fixed plow panel in a first position and extending lengthwise from the fixed plow panel in a second position an extending actuator attached to the fixed plow panel at a first end and the sliding plow panel at a second end and having a first tube and a second tube, the second tube sliding within the first tube, the first tube and the second tube have a keyed cross-sectional shape that minimizes rotation of the first tube in relation to the second tube, the extending actuator moving the sliding plow panel to the first and second positions; and a sweeping actuator attached to the walker-shield connecting bar at a first end and the swing-arm plow at a second end to push the swing-arm plow in an arc around the hinge.

15. A method of removing a shield from a shield panel in a longwall mining operation, comprising:

arranging a walker-shield perpendicular to the shield to be removed;

attaching the walker-shield to a walker-shield connecting bar;

attaching a swing-arm plow to the walker-shield connecting bar by a hinge;

removing the shield to be removed; and operating a swing-arm plow to push debris away from the vicinity of the shield being removed.

16. The method of claim 15, further comprising attaching the walker-shield connecting bar to the walker-shield by a chain and hook fastened along a long side of the walker-shield connecting bar.

17. The method of claim 16, further comprising:

returning the swing-arm plow to its original position;

moving the walker-shield; and repeating operation of the swing-arm plow.

18. A method of operating a swing-arm plow, comprising:

attaching the fixed plow to a walker-shield using a bar, the fixed plow attached to the bar by a hinge, such that the sweeping actuator moves in an arc from the bar actuating an extending actuator to extend a sliding plow in alignment with a fixed plow;

actuating a sweeping actuator to sweep debris with the fixed and sliding plows;

retracting the sweeping actuator; and retracting the extending actuator.

19. The apparatus of claim 18, further comprising returning the swing-arm plow to its original position, moving the walker-shield, and repeating actuation of the swing-arm plow.

* * * * *